United States Patent [19]

Miller

[11] 4,102,383

[45] Jul. 25, 1978

[54] WINDOW SHADE

[75] Inventor: Gerald W. Miller, Cincinnati, Ohio

[73] Assignee: Clopay Corporation, Cincinnati, Ohio

[21] Appl. No.: 732,715

[22] Filed: Oct. 15, 1976

[51] Int. Cl.[2] ..... A47G 5/02

[52] U.S. Cl. ..... 160/263

[58] Field of Search ..... 160/250, 263, 323 R-326, 160/387, 84 R; 83/6; 225/2; 242/56.8

[56] References Cited

U.S. PATENT DOCUMENTS

| | | | |
|---|---|---|---|
| 2,943,676 | 7/1960 | Grenci | 160/387 |
| 3,203,468 | 8/1965 | Gossling et al. | 160/236 |
| 3,299,944 | 1/1967 | Gossling et al. | 160/263 |
| 3,308,874 | 3/1967 | Anderson | 160/326 |
| 3,780,921 | 12/1973 | Harp | 225/2 |
| 3,913,655 | 10/1975 | Ogino | 160/84 R |
| 4,006,770 | 2/1977 | Ferguson | 160/263 |

*Primary Examiner*—Peter M. Caun

*Attorney, Agent, or Firm*—Wood, Herron & Evans

[57] ABSTRACT

This invention is directed to a window shade whose width can be decreased, without cutting instruments, to conform to the size of the window opening into which the shade is to be mounted. The window shade includes a roller and a shade secured to the roller having at one or both edges a plurality of spaced strip lines, preferably invisible, extending from end-to-end parallel to the shade edges. The strip lines permit hand-stripping of discrete widths of the shade while the shade is rolled on the roller. The roller includes substantially coincident with the strip lines of the shade a plurality of longitudinally spaced, circumferentially extending strip lines permitting removal of a corresponding discrete length of the roller. In accordance with the invention disclosed, the shade includes a plurality of integral tabs at the hem end of the shade whose edges generally coincide with the strip lines to facilitate the stripping of discrete widths of the shade.

5 Claims, 4 Drawing Figures

WINDOW SHADE

CROSS REFERENCE TO RELATED APPLICATIONS

This application is related to U.S. Ser. No. 688,063, filed May 19, 1976, and assigned to the assignee of this invention.

BACKGROUND OF THE INVENTION

This invention relates to a window shade and, more particularly, to an improved window shade which can be sized to a window, when rolled, without the need for cutting instruments.

In the above-referenced application, there is disclosed a window shade wherein the shade width may be shortened by the consumer in the home, without unrolling of the shade, to accommodate window openings of various sizes and wherein the shortened shade has smooth, straight edges and hangs without drooping or wrinkling. In the general aspect, that invention provides a window shade including a roller and a shade secured to the roller having at one or both edges a plurality of spaced, hand-strip lines extending from end-to-end, i.e., from top-to-bottom, substantially parallel to the edges. The strip lines permit hand-stripping of discrete predetermined widths of the shade while the shade is rolled on the roller thereby eliminating any requirement for cutting of the shade material. The roller is provided with a plurality of longitudinally spaced, circumferentially extending strip lines substantially coincident with the lines of the shade to permit removal of discrete lengths of the roller corresponding to reduction of the width of the shade.

The roller upon which the shade material is mounted may take any of the several forms described in detail in the referenced application. For example, the roller may take the form of the rollers disclosed in U.S. Pat. Nos. 3,203,468; 3,299,944; and 3,580,323, all assigned to the assignee of this invention, which generally comprise two sections, one being telescopable into the other, for fully supporting the shade material across its upper edge while permitting the smaller roller to telescope into the larger one. In all of the roller forms, the interrelationship of roller and shade material provides full support for the shade material whereby the shade hangs with smooth, straight edges and without drooping or wrinkling, regardless of the width of shade material removed in sizing the shade. In sum, the invention disclosed in the referenced application eliminates the need for any cutting of the shade and the need heretofore for cutting machines whereby a window shade can be simply and conveniently sized by the consumer in the home, without unrolling of the shade material, with the sized shade having smooth, straight edges and hanging without drooping or wrinkling.

The steps required to decrease the width of the shade include grasping the shade at its hem with the shade being in the rolled position on the roller, stripping off a desired width of the shade material by unwinding the shade along a chosen strip line, and removing a corresponding length of material from the roller. However, as is typical in window shades, the hem is formed by folding the shade material upon itself along the end opposite the end attached to the roller to form two overlapping portions which are joined together along a hem line extending between the edges of the shade. A hem stick is inserted in the hem for grasping for raising and lowering the shade. Accordingly, to size the shade heretofore described, is is necessary to grasp a double thickness of shade material and to locate a hand-strip line to begin the shortening operation. However, difficulty has been encountered in locating the strip line at the hem particularly where the hand-strip lines are invisible, as in the preferred form, as well as in initiating stripping through a double thickness of shade material.

SUMMARY OF THE INVENTION

This invention overcomes these problems associated with hand-stripping of the window shade to provide a window shade for accommodation in window openings of various sizes. In accordance with the principles of the invention, the shade is provided at the hem with a plurality of hand-graspable tabs, preferably formed of a single thickness of the shade material itself, whose edges generally coincide with the hand-strip lines. The tabs extend between the hem line and free end of the shade and are adapted to be grasped and pulled to separate the overlapping portions of the shade. Thereafter, the shade can be conveniently hand-stripped, without unrolling of the shade material, in the manner described in the above-referenced copending application.

In the general aspect, this invention provides a window shade including a roller and a shade secured to the roller having at one or both edges a plurality of spaced, hand-strip lines extending from end-to-end substantially parallel to the shade edges. The roller includes at one or both ends a plurality of longitudinally spaced, circumferentially extending strip lines substantially coincident with the lines of the shade. The roller upon which the shade material is mounted may take several forms. For instance, the roller may simply comprise a length of material such as a tube of paper or plastic. Such a roller may further comprise motor and pin ends mounting means which are adapted for end mounting. Another roller form comprises telescoping members having at one or both ends strippable portions. Also, a telescoping roller assembly is provided with a tube of material onto which the shade material is secured.

The end of the shade opposite that secured to the roller is folded upon itself and joined along a hem line extending from edge-to-edge to form the shade hem. In one presently preferred form of the invention, the overlapping portions of the shade are joined at spaced points intermediate the hand-strip lines and continuing across the shade with the same spacing. Between the hem line and free end of the shade are formed the tabs whose edges generally coincide with the hand-strip lines, the tabs being a single thickness of shade material which are adapted to be grasped by hand.

The steps required to shorten the shade include simply grasping the tab with the shade being in its rolled position on the roller, pulling the tab to separate the overlapping shade portions at the hem line joint, stripping off a desired width of shade material by unwinding the shade material long a chosen strip line, and removing a corresponding length of roller material from the roller. The roller-shade assembly is thus more conveniently shortened by hand. The invention further admits of contouring of the tab between strip lines to further facilitate the loating of the tab and its grasping.

In summary, the window shade of the present invention overcomes the disadvantages associated with the window shade disclosed and described in the above-referenced copending application by providing for improved hand-stripping of the shade while achieving all of the advantages thereof including shortening of the shade in substantially fewer steps than in prior art shades while eliminating any droopings, wrinkling, etc. of the shade material. These and other advantages of the invention will be further appreciated by reference to the following detailed description and accompanying drawings.

DETAILED DESCRIPTION OF THE INVENTION

Figure 1:
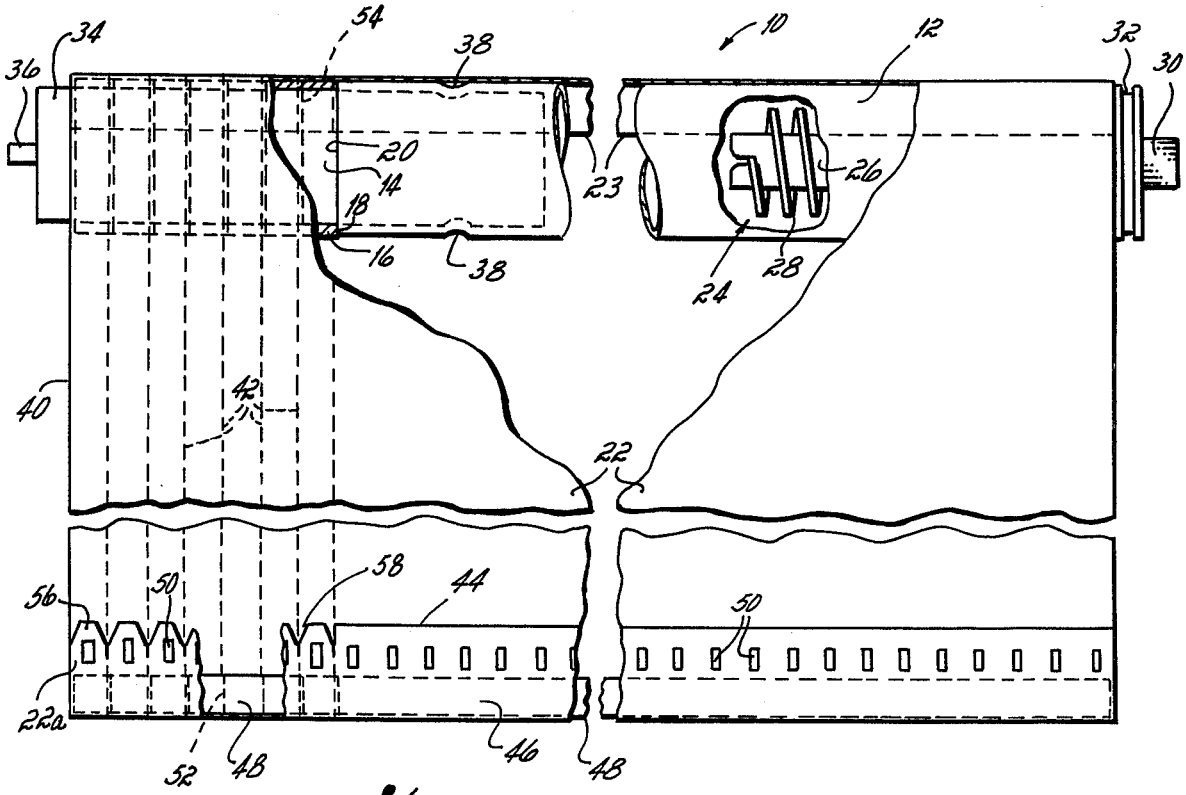
FIG. 1 is a rear elevational view, partly in section, showing a preferred form of the invention.

Referring to FIG. 1, the window shade includes a roller 10 comprising a first tubular roller member 12, a second member 14, having one end thereof telescopingly seated within the first member 12, and a tube 16 surrounding the axially projecting portion of the second member 14. The tube 16 has the same inside and outside diameter dimensions as the first member 12, and the inside diameter is slightly larger than the diameter of the second member 14 allowing the second member 14 to freely telescope into the first member 12. The tube 14 abuts at one end 18 to the inner end 20 of the first member 12 forming a smooth outside roller surface extending from end-to-end of the roller 10. A roller of the type shown in FIG. 1 is disclosed in U.S. Pat. No. 3,203,468, and that disclosure is incorporated by reference.

A shade 22 is attached to the roller 10 along one end 23. The particular method of attachment is not critical, and a suitable method is by means of an adhesive strip as disclosed in U.S. Pat. No. 2,599,410. Alternatively, the shade could be attached in other known ways.

The right end of the roller 10, as viewed in FIG. 1, is adapted to receive a spring motor 24 which includes a torque rod 26 connected to one end of a rewind spring 28. The torque rod 26 is fixed to a spear 30 which projects from the end of the roller 10 and is engageable with a flat slot of a window shade bracket by which the window shade is supported in the window opening. A cap 32 encloses a clutch and other operating mechanism (not shown) through which the spring and torque rod are connected to the roller to rotate the roller in winding the shade 22 on the roller 10. At the other end of the shade, the roller 10 is adapted to receive a pin end plug or cap 34. Projecting from the pin end cap 34 is a cylindrical gudgeon pin 36 which is engageable with and rotates in the other of the window brackets supporting the window shade in the window opening. Preferably, the pin end cap 34 has the same or slightly smaller diameter as the second member 14 to permit the tube portion separated in the shortening operation to be slid off the roller without obstruction by the pin end cap.

The particular means by which the telescoping second member 14 is seated in the first member 12 is not critical. For example, with a metal tubular first member and a wooden dowel or plastic cylinder forming the second member, the dowel may be held in the steel roller principally by dimples 38 which are depressed into the surface of the metal roller a distance sufficient to cut into the soft wooden dowel as it is forced into the metal roller. The dimples prevent both axial and rotative movement of the second member with respect to the first. With an all metal roller, a convenient form of mounting is that described in U.S. Pat. No. 3,203,468, particularly in relation to FIG. 10, wherein the smaller roller formed from sheet metal is seamed to provide a longitudinal groove adjacent the seam into which the seam of the larger roller member is keyed. The cooperation between the seam and the groove prevents relative rotation of the two roller members.

In the embodiment shown in FIG. 1, the tube 16 is not affixed to the second member 14. The adhesive securing the shade 22 to the first roller member 12 and to the tube 16 holds the tube 16 in proper position with respect to the first roller member 12 so that the tube 16 forms in effect an extension of the first member 12. The adhesive prevents the paper tube from rotating with respect to the first member, and the tube prevents any drooping of the shade material.

The shade 22 at its one edge 40 includes a plurality of spaced, hand-strip lines 42 extending from one end, i.e., from the free end 44 of the shade 22 to the opposite end 23 secured to the roller 10. The lines 42 are substantially parallel to the edge 40 of the shade and are separated by a predetermined distance to permit decreasing of shade width by any amount up to the total or sum of separations. For example, the shade may conveniently be formed with 24 strip lines separated by ½ inch increments thus permitting shortening of the shade from ½ inch up to 12 inches. At the bottom of the shade 22 is a hem 46 into which a slat 48 is inserted for grasping for raising and lowering the shade. The hem 46 is formed by joining the overlapping portions *22a, 22b* of the shade at points 50 intermediate the hand-strip lines 42 and continuing on at equalled spaced intervals for the remainder of the shade width. The hem 46 is preferably formed by folding shade portion *22a* behind the shade and joining it to portion *22b* such that the free end 44 is behind and not visible from the room side of the shade. When the shade 22 is formed of a plastic sheet material the overlapping shade portions may be conveniently joined by heat sealing the portions together at the spaced points 50, shown in FIG. 1 as rectangular-shaped joints, intermediate the hand-strip lines 42 and continuing across the shade width at the same intervals. The particular shade material and means of forming the hem line is, of course, not critical; and other materials and forms, e.g., a paper or fabric shade having a stitched or adhesively joined hem line, are likewise applicable.

The slat 48 includes a plurality of spaced lines 52, e.g., perforations, serrations, or the like providing lines of weakness, preferably generally coincident with the strip lines, to permit the convenient breaking off of excess slat length on shortening of the shade. The slat may alternatively be telescoping.

The particular manner of forming the strip lines in the shade 22 is not critical to the invention and may comprise any of a number of known methods of weakening material along a line permitting hand-stripping of the material along the line while leaving a smooth, straight edge. For example, in woven shades, strip lines may be formed during the weaving process by some means of fiber orientation or thereafter by perforating or serrating the shade material along a line. In shades formed of plastic material, the lines may be formed by weakening the material along a line or by such mechanical means as scoring, perforating, or serrating or by otherwise decreasing the thickness of the shade material along continuous lines. Although any means is suitable when a smooth shade material is provided, it is desirable that the lines be invisible to maintain the aesthetic appeal of the shade. Where the shade material is patterned or embossed the lines may form a part of the pattern and thus, even though visible, do not noticeably affect the aesthetics of the shade.

The tube 16 is also provided with a plurality of strip lines 54 longitudinally spaced along the tube 16 and extending about the circumference of the tube to permit removal of a discrete length of roller tube corresponding to the decrease in shade width. These lines are so aligned as to be substantially coincident with the strip lines 42 of the shade when the shade is secured to the roller 10. These lines 54 may be formed by perforating, serrating or otherwise weakening the tube. For example, if the tube is formed of a cuttable paper material it may be conveniently serrated or perforated about its circumference. Tubes formed of plastic or metal may be mechanically weakened along circumferential lines, for example, to allow separation of tube length by grasping of the shade and twisting off the unwanted section or sections.

A plurality of tabs 56 are formed at the end of shade portion 22*a* extending between the hem joints 50 and the free end 44 of the shade. The tabs are integral with the shade 22*a* and comprise a single thickness of shade material. The portion tabs 56 may take a number of configurations including merely square ends wherein a slight slit is made to form the edges of the tab, or they may be contoured, as illustrated in FIG. 1, wherein V-shaped recesses 58 are formed to define the edges of the tab. In any form, however, the edges of the tabs generally coincide with the hand-strip lines 42. Contouring of the tabs serves to clearly define the plurality of tabs and their edges and provides for convenient stripping. As may be seen in FIG. 1, the vertex of each V-shaped recess having a desired radius of curvature lies on a strip line thereby clearly indicating the locations of the strip lines 42.

Figure 2:
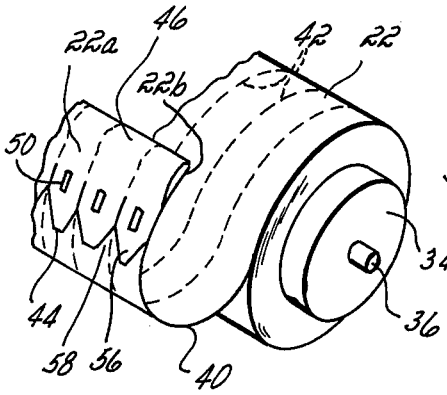
FIGS. 2–4 are pictorial views illustrating the steps of shortening a shade in accordance with the present invention.
Figure 3:
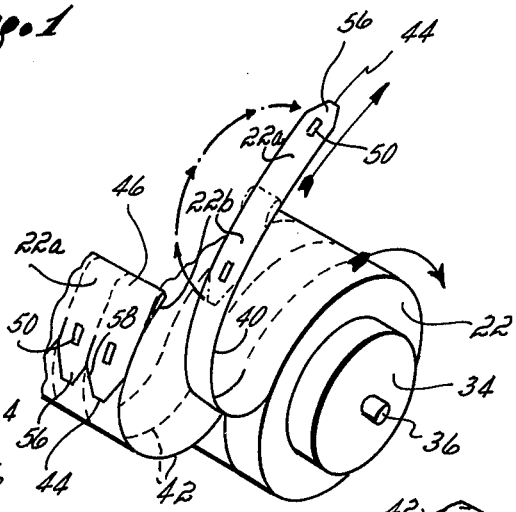
Figure 4:
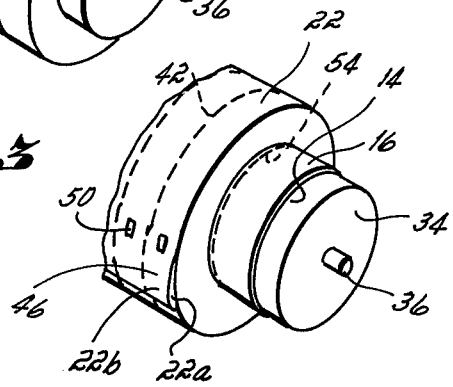

Referring now to FIGS. 2–4 in shortening the shade width to the desired size, only a few simple steps are required. The desired shade width is determined by measuring the window opening or by placing the shade against the window opening to determine the tab 56 whose edge lies on the strip line corresponding to the window opening along which the shade is to be stripped. The slat 48 is slid axially out of the hem a distance sufficient to allow excess shade material to be stripped. With the shade in the rolled condition, the material is grasped at the tab 56. As shown in FIG. 3, to commence stripping the tab 56 is pulled so as to separate the overlapping portions 22*a*, 22*b* of the shade at the hem joint 50. Thereafer, the shade material is separated along the chosen strip line 42 by continued pulling on the tab 56. As shown in FIG. 3, stripping commences at the tab of the shade and proceeds by unwinding of the shade material with the material separating along and following the strip line 42 until it reaches the roller tube 16. This separation can be done quite rapidly, and the entire operation thus far is accomplished essentially with one continuous pulling motion. At the tube 16, the material is ripped to separate it from the adhesive thus exposing its corresponding length of roller tube to be removed. This section of roller tube is removed by, for example, twisting the tube section off or, in the case of a cuttable paper tube, by cutting the tube along the circumferential strip line with a household paring knife. Since the tube has an inside diameter slightly greater than the diameter of the second member 14, the excess tube length is easily slid over the end of the second member and the pin end cap 34. The last step required consists of merely pushing the second member 14 into the hollow first member 12. The force required to push the second member into the first member is slight enough to be done by hand. The hem slat 48 is now replaced and the excess length is broken off at the closest line of weakness. If a telescoping slat is used, it is telescoped to conform to the width of the now shortened shade.

Although my invention has been described in terms of its presently contemplated best mode, it will be appreciated by those skilled in the art that obvious variations may be made in view of the above description to obtain the benefit thereof. In particular, it will be appreciated that although my invention has been described in relation to a particular roller, my invention may likewise be employed with any of the forms of window shades and rollers disclosed in the above-referenced copending application, which is incorporated herein by reference.

Thus having described the invention, what is claimed is:

1. A window shade comprising, in combination, a roller having a telescoping member receivable in one end, a shade secured along one end of said roller and extending between the ends of said roller, and having an opposite free end, said shade having a hem opposite said end secured to said roller formed of overlapping shade portions joined along a hem line spaced from the free end of said shade, and having at least one edge thereof a plurality of spaced hand-strip lines extending from end-to-end substantially parallel to said edge such that discrete widths of said shade may be hand-stripped along said lines from said free end of said shade to provide a smooth, straight edge after stripping, said roller including at least at its end receiving the telescoping member a plurality of longitudinally spaced, circumferentially extending strip lines substantially coincident with said lines of said shade adapted to permit removal of discrete lengths of said roller corresponding to said discrete widths of said shade hand-stripped therefrom, and a plurality of tabs associated with said hem, each said tab extending between said hem line and said free end of said shade, the edges of said tabs being substantially coincident with said hand-strip lines, said tabs being adapted to be grasped and pulled to separate said overlapping shade portions and initiate stripping along said lines from said free end of said shade toward said end secured to said roller while said shade is rolled on said roller.

2. The window shade of claim 1 wherein said tabs are integral with said shade.

3. The window shade of claim 2 wherein said tabs are contoured.

4. The window shade of claim 1 wherein said overlapping portions are joined at spaced points intermediate said strip lines.

5. The window shade of claim 1 wherein said shade is formed of plastic and said overlapping portions are joined by heat sealing.

* * * * *

UNITED STATES PATENT AND TRADEMARK OFFICE

CERTIFICATE OF CORRECTION

PATENT NO. : 4,102,383

DATED : July 25, 1978

INVENTOR(S) : Gerald W. Miller

It is certified that error appears in the above-identified patent and that said Letters Patent are hereby corrected as shown below:

Col. 2, line 2 "is is" should be --it is--

Col. 2, line 63 "loating" should be --locating--

Col. 6, line 34 "at least one" should be --at least at one--

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*